United States Patent [19]

Betts

[11] 4,030,470

[45] June 21, 1977

[54] LINED ENGINE BLOCK MEMBER INCLUDING A THREADED OPENING AND METHOD FOR PROVIDING SAME

[75] Inventor: E. Douglas Betts, Gurnee, Ill.

[73] Assignee: Outboard Marine Corporation, Waukegan, Ill.

[22] Filed: Dec. 12, 1974

[21] Appl. No.: 531,920

[52] U.S. Cl. ..... 123/193 C; 92/169

[51] Int. Cl.[2] ..... F02F 1/08

[58] Field of Search ... 123/193 C, 193 CH, 193 CP, 123/32 AA, 193 R; 92/169, 171

[56] References Cited

UNITED STATES PATENTS

| | | | |
|---|---|---|---|
| 2,234,780 | 3/1941 | Rippingille | 123/193 CH X |
| 2,456,272 | 12/1948 | Gregory | 123/193 CH |
| 2,703,077 | 3/1955 | Antonsen | 123/193 C |
| 2,736,300 | 2/1956 | Flynn, Jr. | 123/193 CH X |
| 3,379,179 | 4/1968 | Mantrel | 123/193 CH X |
| 3,492,977 | 2/1970 | Fagei | 123/193 C X |

*Primary Examiner*—Charles J. Myhre

*Assistant Examiner*—Ira S. Lazarus

*Attorney, Agent, or Firm*—Michael, Best & Friedrich

[57] ABSTRACT

A threaded opening in an engine block member including a cast-in liner having an outer surface and an inner surface forming at least a portion of an interior wall of a combustion chamber and a die cast outer body is provided by forming first and second concentric apertures in the liner prior to casting the outer body with the first aperture extending entirely through the thickness of the liner and the second aperture having an inner diameter larger than that of the first aperture and terminating short of the liner inner surface. A cylindrical insert of sufficient length to provide the axial length of the threaded opening is press fitted or threaded into the second aperture with a portion extending above the outer surface of the liner. The outer body is thereafter cast over the outer surface of the liner and the outer surface of the insert and an internal threaded opening is drilled and tapped in the insert so that a part threaded into the insert can communicate with the combustion chamber.

7 Claims, 7 Drawing Figures

LINED ENGINE BLOCK MEMBER INCLUDING A THREADED OPENING AND METHOD FOR PROVIDING SAME

BACKGROUND OF THE INVENTION

When cylinder blocks for internal combustion engines are cast from an aluminum alloy, it is common practice to provide a cast-in ferrous liner which forms an interior wall or surface of the combustion chamber and is heat treated or surface hardened in some manner to form a wear resistant surface. For the installation of components adapted to communicate with the combustion chamber, such as a lubrication fitting, a pressure relief valve or a fuel injection nozzle, a port or opening must be formed through both the outer housing or body and the liner. Extreme care must be exercised to insure that the aluminum does not seep through the liner port onto the wear surface of the liner during the casting operation. Also, when forming a threaded opening in the cylinder block, it is desirable that the drilling and tapping operations be performed in a single homogeneous material rather than across the interface of the dissimilar metals of the liner and the cylinder block housing.

SUMMARY OF THE INVENTION

The invention provides a method for forming a threaded opening in an engine block member defining a portion of a combustion chamber and including a cast outer body and a cast-in liner having an outer surface and an inner surface forming at least a portion of an interior wall of the combustion chamber, wherein the threaded opening, although extending through the body and the liner to communicate with the combustion chamber, is formed in a single material.

More specifically, the method provided by the invention includes the steps of forming first and second concentric apertures in the liner with the first aperture extending through the thickness of the liner and the second aperture having an inner dimension larger than the inner dimension of the first aperture and terminating short of the inner surface of liner, providing an insert having an outer dimension adapted to provide a tight fit with the second aperture, installing the insert into the second aperture, casting the outer body onto the outer surface of the liner, and forming an internal threaded opening through the axial length of the insert in communication with the first aperture. The insert preferrably is provided with an axial length longer than the axial length of the second aperture so that after being installed into the second aperture, a portion of the insert extends above the outer surface of the liner and the outer body is cast onto at least a portion of the extended portion of the insert during the casting step.

In a preferred embodiment of the invention, the liner is treated to harden the inner surface thereof and the first and second apertures are formed in the liner prior to such treatment.

The invention provides an engine block member defining a portion of a combustion chamber including a liner having an outer surface and an inner surface forming at least a portion of an interior wall of the combustion chamber, first and second concentric apertures in the liner with the first aperture extending through the liner from the outer surface to the inner surface thereof and the second aperture having an inner dimension larger than the inner dimension of the first aperture and terminating short of the inner surface of the liner, an insert fitting tightly inside the second aperture and including an internally threaded opening communicating and in general axial alignment with the first aperture for threadedly receiving a part adapted to communicate with the combustion chamber and an outer body integrally adjoining the outer surface of the liner.

One of the principal features of the invention is the provision of a method for fabricating an engine block member which includes a cast outer body and an internal cast-in liner forming at least a portion of the interior wall of a combustion chamber and which has a threaded opening communicating with the combustion chamber but without crossing the interface between the outer body and the liner.

Another of the principal features of the invention is the provision of such a method wherein, during the casting of the outer body, flow of the molten material onto the inner surface of the liner is minimized.

Still another of the principal features of the invention is the provision of an engine block member including a cast outer body, a cast-in internal liner forming a portion of an interior wall of a combustion chamber, and separate means mounted in the liner and including an internally threaded opening for receiving a part adapted to communicate with the combustion chamber.

Other features, advantages and aspects of the invention will become apparent upon reading the following detailed description, the drawing, and the appended claims.

Before explaining the invention in detail, it is to be understood that the invention is not limited in its application to the details of the construction and arrangement of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

DESCRIPTION OF THE PREFERRED EMBODIMENTS

Figure 1:
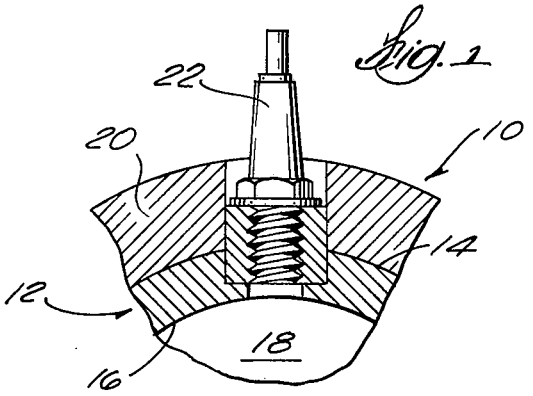
FIG. 1 is a fragmentary top view, in section, of an engine block member embodying various of the features of the invention.

Shown fragmentarily in FIG. 1 is an engine block member 10 including a cast-in liner 12 having an outer surface 14 and an inner surface 16 which forms at least a portion of an internal wall or surface of a combustion chamber 18, a cast outer body 20, preferably die cast from an aluminum alloy, and a threaded fitting 22 (e.g., a fitting for introducing lubricating oil into the combustion chamber, a pressure relief valve, or a fuel injection nozzle) mounted in the engine block member 10 and communicating with the combustion chamber 18.

FIGS. 2 through 5 illustrate the various steps of the method provided by the invention. The liner 12 is of conventional design and preferably is formed from a ferrous alloy which is capable of being heat treated or otherwise surface hardened to provide a hard, wear-resistant inner surface 16. The liner 12 is self-supporting and preferably is formed by a conventional sintering process but also can be formed by other conventional processes such as by die casting or extruding. In FIGS. 2 through 7 the fragmentary sections of the various components of the engine block member 10 are shown as being generally flat so as to simplify the illustrations.

Figure 2:
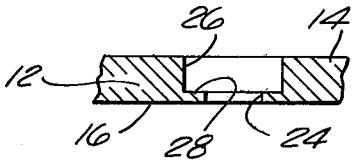

Referring to FIG. 2, concentric first and second apertures 24 and 26 are machined or otherwise suitably formed into the liner 12 prior to the surface hardening treatment. The first aperture 24 extends entirely through the thickness of the liner 12 and has an inner diameter generally corresponding to the desired size of the opening into the combustion chamber 18. The second aperture 26 has an inner diameter somewhat larger than the diameter of the first aperture 24 and includes a bottom wall 28 which terminates short of the inner surface 16 of the liner 12. After the apertures 24 and 26 have been formed, the liner 12 is subjected to treatment for hardening the inner surface 16 (e.g., heat treated). When the liner is formed by sintering from a ferrous powder, the apertures 24 and 26 can be formed in the liner 12 as part of the powder molding step prior to sintering.

Figure 3:
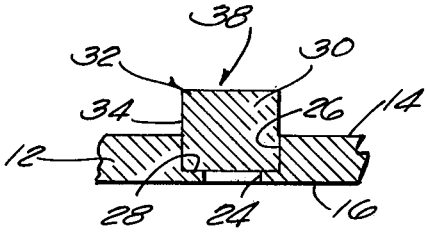

Provided for threadedly receiving the fitting 22 is a generally cylindrical, elongated insert 30 which has an outer diameter sized to provide a substantially interference fit with the wall of the second aperture 26. The insert 30 has an axial length at least as long as the threaded portion of the fitting 22 and preferably includes an upper portion 32 which extends some distance above the outer surface 14 of the liner 12 (FIG. 3). In order to minimize stripping of the internal threads subsequently formed therein as described below, the insert 30 is formed from a relatively high strength material, preferably from a ferrous alloy similar to that used for the liner 12.

Figure 4:
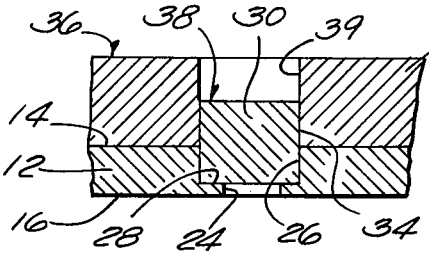

After the insert 30 has been press fitted into the second aperture 26, the outer body 20 is die cast about the outer surface 14 of the liner 12 and the outer peripheral surface 34 of the upper portion 32 of the insert 30 as shown in FIG. 4. The surfaces of the outer body 20 adjoining the outer surface 14 of the liner 12 and the insert 30 are integrally bonded thereto during this casting step. The outer surface 36 of the outer body 30 can extend above the top surface 38 of the insert 30 as shown in FIG. 4, can be generally coplanar with the insert top surface 38, or spaced below the insert top surface 38. If desired, the outer body 20 can be cast to cover the top surface 38 of the insert 30, in which case a clearance hole 39 for receiving the fitting 22 is machined into the outer body 20 after the casting step. Since the insert 30 fits tightly inside the second aperture 26, flow or seepage of the molten outer body material through the first aperture 24 and onto the inner surface 16 of the liner 12 is minimized during the casting step.

Figure 5:
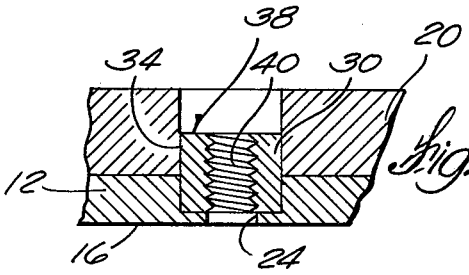
FIGS. 2 through 5 are enlarged, fragmentary views of various portions of the engine block member shown in FIG. 1 illustrating the fabrication steps in accordance with the method of the invention.

Following the casting step, an internally threaded opening 40 for receiving the fitting 22 is drilled and tapped in a conventional manner through the entire axial length of the insert 30. The opening 40 preferably is in general axial alignment with the first aperture 24 as shown in FIG. 5. Thus, the threaded opening 40 is provided entirely in the insert 30 and does not cross the interface of the dissimilar materials from which the liner 12 and the outer body 20 are formed. If desired, the top surface 38 of the insert 30 can be machined, either before or after forming the threaded opening 40, to provide a smooth seat for the fitting 22.

Figure 6:
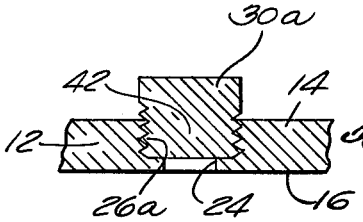
FIG. 6 is an enlarged fragmentary view of an alternate insert and liner construction.

FIG. 6 illustrates an alternate insert and liner construction liner wherein the second aperture 26*a* is provided with internal threads and at least the lower portion 42 of the insert 30*a* is provided with external threads so that the insert 30*a* can be screw fitted into the liner instead of being press fitted as described above. With this construction, the insert 30*a* can be installed into the liner 12 prior to the hardening treatment thereof, if desired.

Figure 7:
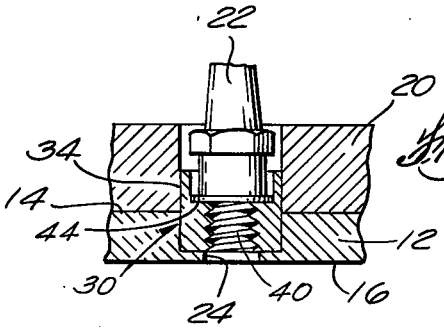
FIG. 7 is an enlarged fragmentary view of another alternate insert and liner construction.

In the alternate insert and liner construction illustrated in FIG. 7, the insert 30 is counterbored after the threaded opening 40 is formed therein to provide a recessed seat 44 for the fitting 22.

While in the specific constructions illustrated, the apertures 24 and 26 and the insert 30 have a circular cross section, other configurations can be used so long as the first aperture 24 is large enough to provide clearance for the tools used for drilling and tapping the threaded opening 40 in the insert 30 and the second aperture 26 and the insert 30 are dimensioned to provide a tight fit therebetween.

Various of the features of the invention are set forth in the following claims:

What is claimed is:

1. An engine block member defining a portion of a combustion chamber including a liner having an outer surface and an inner surface forming at least a portion of an interior wall of the combustion chamber, first and second concentric apertures in said liner, said first aperture extending entirely through the thickness of said liner from said outer surface to said inner surface, said second aperture having an inner dimension larger than the inner dimension of said first aperture, extending from said liner outer surface, and terminating short of said liner inner surface, an insert fitting tightly inside said second aperture and including an internally threaded opening for threadably receiving a part adapted to communicate with said combustion chamber, and an outer body cast substantially continuously along said liner outer surface and along at least a part of said insert.

2. An engine block member according to claim 1 wherein said liner is formed from a sintered ferrous material and said outer body is cast from an aluminum alloy.

3. An engine block member according to claim 1 wherein said insert has an axial length longer than the axial length of said second aperture and an upper portion extending outwardly beyond said liner outer surface and having an outer peripheral surface, and said outer body is cast about at least a portion of said outer peripheral surface.

4. An engine block member according to claim 1 wherein said insert includes a machined top surface adapted to serve as a seat for the part threaded into said insert opening.

5. An engine block member according to claim 1 wherein said insert includes a top surface having a counterbore concentric with said threaded opening to serve as a recessed seat for the part threaded into said insert opening.

6. An engine block member according to claim 1 wherein said insert is press fitted inside said second aperture.

7. An engine block member according to claim 1 wherein said second aperture includes internal threads and threadably receives said insert.

* * * * *